United States Patent [19]

Robison

[11] 3,960,465

[45] June 1, 1976

[54] AUTOMOTIVE FAN CLUTCH LOCK

[76] Inventor: Howard A. Robison, 3429 Lewis Ave., Long Beach, Calif. 90807

[22] Filed: Dec. 19, 1974

[21] Appl. No.: 534,464

[52] U.S. Cl. ..... 416/169 R; 416/244 B

[51] Int. Cl.[2] ..... F04D 29/32

[58] Field of Search ..... 416/169, 244; 192/83, 192/58 A–58 C

[56] References Cited

UNITED STATES PATENTS

| | | | |
|---|---|---|---|
| 1,232,132 | 7/1917 | Ward | 192/41 R |
| 1,360,394 | 11/1920 | Gordon | 192/85 AA |
| 1,467,537 | 9/1923 | Dornier | 416/169 X |
| 1,743,170 | 1/1930 | Vail | 192/105 C |
| 2,819,703 | 1/1958 | Suttle | 416/169 UX |
| 2,879,755 | 3/1959 | Weir | 192/58 A X |
| 2,986,250 | 5/1961 | Becker | 416/169 X |
| 3,075,691 | 1/1963 | Kelley | 416/169 X |
| 3,363,734 | 1/1968 | Sabat | 192/58 B |
| 3,708,048 | 1/1973 | Szynka | 192/83 |
| 3,741,359 | 6/1973 | Leichliter | 192/58 A X |

FOREIGN PATENTS OR APPLICATIONS

| | | | |
|---|---|---|---|
| 601,571 | 3/1926 | France | 416/169 |

*Primary Examiner*—Everette A. Powell, Jr.
*Attorney, Agent, or Firm*—Fulwider, Patton, Rieber, Lee & Utecht

[57] ABSTRACT

There is disclosed a detachable lock mechanism which can be installed on automotive-type cooling fans having a conventional fan clutch connection between the fan and the fan drive shaft. The lock mechanism functions by providing a positive mechanical lock between the drive shaft and the cooling fan, thereby bypassing the drive clutch and its function. The locking mechanism provides a desirable positive lock to insure maximum fan speed when operating a vehicle in low gears and low forward speeds. The device is of particular value for off-road service of recreational vehicles and the like which are often operated for extended periods in low gears, conducive to overheating. In these applications, the operation of the fan clutch is detrimental to adequate engine cooling and a mechanical locking mechanism thereby serves a useful function in avoiding overheating of these vehicles. Various locking mechanisms are disclosed including simple detachable brackets which are preferably carried by the flanged end of the fan drive shaft and which have a dependent arm that projects into a locking engagement with the cooling fan.

11 Claims, 10 Drawing Figures

FIG. 1
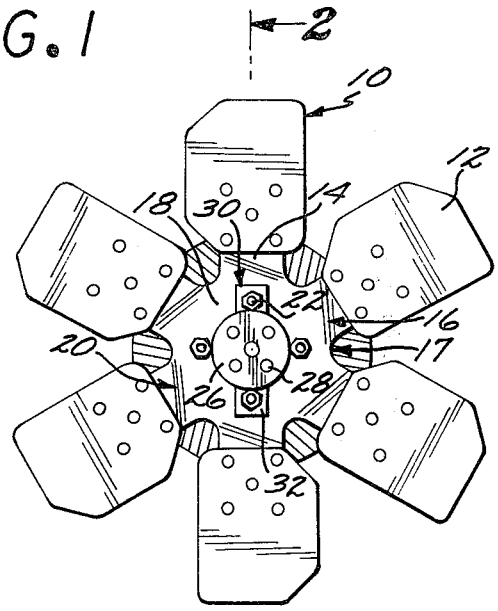
FIG. 2
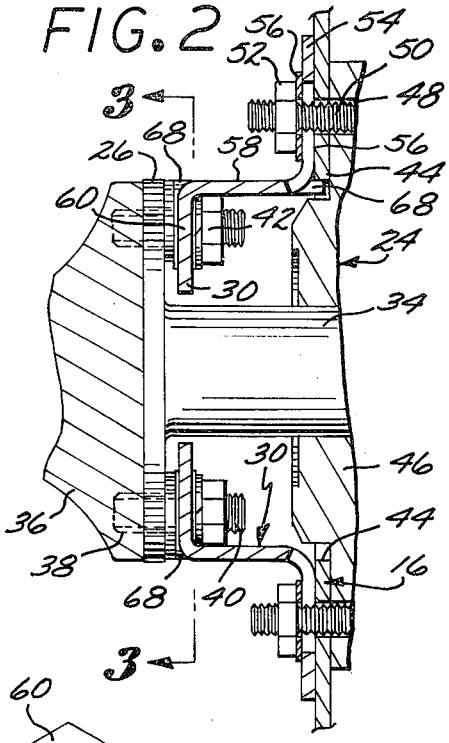
FIG. 3
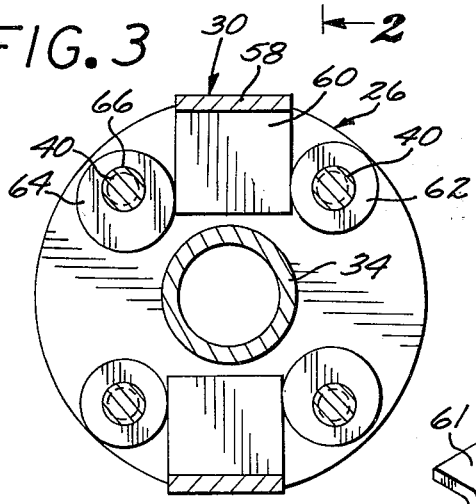
FIG. 5
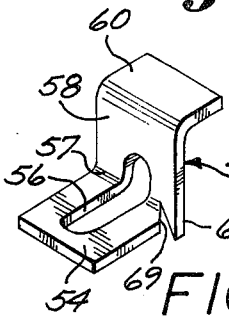
FIG. 6
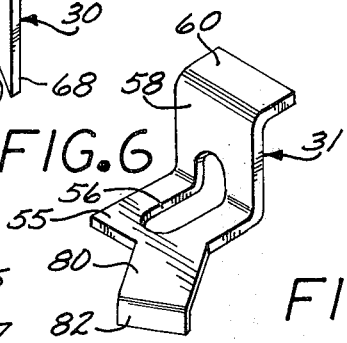
FIG. 7
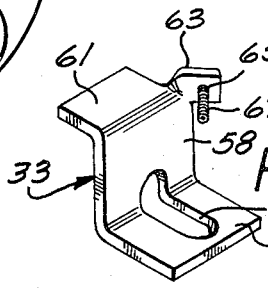
FIG. 8
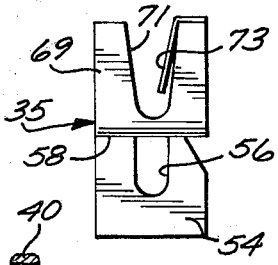
FIG. 4
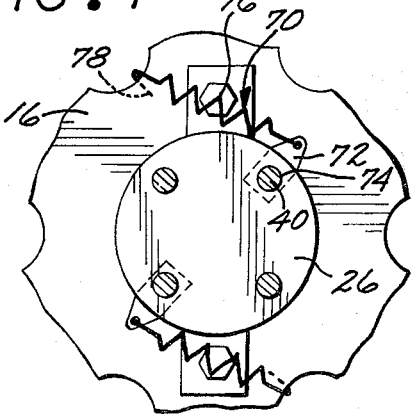
FIG. 9
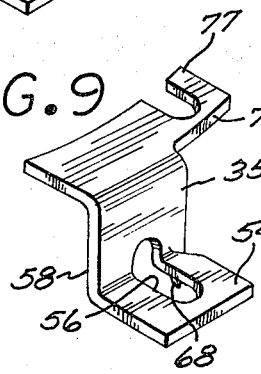
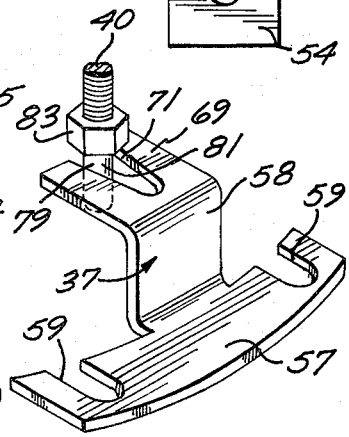
FIG. 10

AUTOMOTIVE FAN CLUTCH LOCK

BACKGROUND OF THE INVENTION

1. Field of the Invention

This invention relates to improvement in automotive cooling fan assemblies and, in particular, to a mechanical lock mechanism to override the operation of a conventional fan drive clutch.

2. Brief Description of the Prior Art

Most automotive engines are presently provided with a drive clutch between the cooling fan and its drive shaft. Commonly, the drive shaft bears a flange on one end which is secured by screw fasteners, i.e., bolts and the like to the hub of the water pump. The cooling fan is mounted on the fan clutch housing which is carried on the opposite end of the fan drive shaft. The fan clutch housing is bolted or otherwise secured to the spider of the cooling fan. Typically, the drive shaft bears a drive plate within the clutch housing which is surrounded by a fluid, and the drag of the plate on the fluid is the coupling between the drive shaft and clutch housing. Centrifical forces developed by rotation of the clutch housing during engine operation serve to pump the fluid from the housing depleting oil from the vicinity of the drive shaft plate and permitting greater slip in the clutch coupling in response to the setting of a control valve. In the more elaborate and expensive clutches, the clutch housing bears a temperature responsive element such as a bi-metallic spring which controls the position of the fluid control valve, closing the valve when the ambient temperature rises to maintain more fluid in the vicinity of the drive plate and reduce the slip between the drive plate and the fluid-filled interior of the housing.

Many of the automotive fan drive clutches lack the aforedescribed temperature responsive valve and, are responsive only to engine speed, providing maximum slip at high engine speeds and minimal slip at low engine speeds.

The aforedescribed fan drive clutches generally provide for efficient engine operation when new or when maintained in good condition or when the vehicle is operated at highway speeds. Often, however, the operation of the clutch deteriorates with age and the engines of older vehicles have a pronounced tendency to overheat with loading. Since the fan drive clutch is relatively expensive, this item is not frequently serviced or replaced and older vehicles frequently suffer overheating problems attributable to a faulty fan clutch. Additionally, fan drive clutches, even when new or when properly maintained, are ill designed for operation on vehicles that are operated at extended periods in low gears with high engine speeds, such as experienced when pulling heavy trailers and/or during off-road driving. In these applications, the centrifical type clutches permit a high degree of slip in the clutch drive to the cooling fan and inadequate cooling frequently occurs, resulting in overheating.

It is, therefore, desirable to provide lock means which can be readily and simply installed on a vehicle to provide a positive, mechanical lock between the cooling fan and the fan drive shaft. Desirably, such lock means should be readily removable from the vehicle and should not require any substantial or significant modifications to the cooling fan assembly. Because of the high rotational speeds of the fan drive shaft and cooling fan, the lock means should have positive means to secure it against any accidental dislodgement.

BRIEF DESCRIPTION OF THE INVENTION

This invention comprises lock means for detachable installation in the assembly of a cooling fan, fan clutch and fan drive shaft and which provides a positive, mechanical coupling between the drive shaft and the cooling fan, thereby defeating the operation and function of the fan drive clutch.

The lock means comprises one or more bracket members, each including a base plate that can be detachably secured to either the shaft flange member on the drive shaft or the spider plate member of the cooling fan by the screw fasteners normally carried on such member. The bracket has an arm, dependent from its base, which extends into engagement with the other end of the shaft flange or spider plate members. Interlocking means are carried on the upstanding end of the arm to lock the arm against rotation past the other member. Typically, the bracket is mounted in the cooling fan assembly with its base secured to the spider of the cooling fan with an upstanding, dependent arm having a lip which projects into a detent position between the screw fasteners carried on the flange of the cooling fan drive shaft. Preferably, the aperture of the base of the bracket is slotted to permit the facile installation of the bracket without disassembly of any of the component parts of the cooling fan and its drive shaft assembly. Preferably, the base of the bracket also bears detent means in the form of a projection that engages an inner peripheral portion of the fan spider, thereby securing the bracket against rotation on the fan spider. A number of alternative embodiments are also disclosed, including resilient spring means interconnecting the drive shaft and cooling fan.

BRIEF DESCRIPTION OF THE DRAWINGS

FIG. 1 is an elevational view, from the engine, of a typical cooling fan assembly;

FIG. 2 is a side sectional view along lines 2—2 of FIG. 1;

FIG. 3 is a sectional view along lines 3—3 of FIG. 2;

FIG. 4 illustrates an alternative embodiment of the lock mechanism;

FIG. 5 is a perspective view of the lock mechanism shown in the assembly of FIGS. 1–3;

FIGS. 6–10 are views of alternative locking mechanisms.

DESCRIPTION OF THE PREFERRED EMBODIMENTS

Referring now to FIGS. 1 and 2, there is illustrated a conventional cooling fan assembly retrofitted with the present invention. As there illustrated, the assembly comprises a cooling fan, generally indicated at 10, which is formed by a plurality of air deflecting blade members 12, that are carried on a plurality of arms 14 of the cooling fan spider 16.

Cooling fan spider 16 is commonly formed as a sheet metal stamping with a central planar area 18 and a plurality of radial arms 14 which are twisted out of the plane of area 18 by bends 20. The spider 16 has a central aperture and a plurality of apertures radially disposed thereto through which are placed screw fasteners such as bolts 22 which connect the spider 16 to the housing 24 of the fan drive clutch. The centrally positioned drive shaft of the assembly has a circular flange 26 which bears a plurality of apertures 28 for the attachment of the drive shaft in driven relationship to the engine, typically for the attachment of the flange 26 to a hub of the water pump of the engine.

The construction of the lock means of the invention and cooling fan assembly can best be seen in FIG. 2. As there illustrated, the drive shaft 34 is shown with a dependent, circular flange 26 secured to hub 36 which is commonly a component of the water pump of the engine. The assembly is maintained by various means; that shown in FIG. 2 comprises a plurality of tapped bores 38 which receive, in threaded engagement, studs 40 which bear nuts 42. Spider 26 bears a central aperture 44 that receives boss 46 of the clutch housing 24. The clutch housing 24 also has a plurality of tapped bores 48 which receive, in threaded engagement, studs 50 that bear nuts 52 to secure spider 16 to clutch housing 24.

Although not illustrated in FIG. 2, the conventional assembly includes a drive plate carried within housing 24 on the inboard end of drive shaft 34. Surrounding this drive plate is a chamber which is filled with a fluid to provide a controllable drag between the fan housing and the drive shaft, thereby providing a controllable slip between the cooling fan carried on the housing and the cooling fan drive shaft 34.

The invention as applied to this assembly is illustrated by the lock means generally indicated at 30. Each lock means comprises a base portion 54 having aperture means 56 to permit its detachable seating and engagement on studs 50. Washer means 56 can be provided between 54 and nut 52.

Each bracket also includes an upstanding arm 58 depending from base 54 and projecting towards the flange 26 of the drive shaft 34. Preferably, arm 58 carries a dependent lip 60 which projects into a rotationally detenting interconnection with screw fastening means such as 42 and 40 carried on flange 26.

Referring now to FIG. 3, there is illustrated the rotationally detenting interconnection of the lock means 30 with the flange 26 of the cooling fan assembly. As illustrated, the lock means 30 has arm 58 with dependent lip 60 in the form of a generally rectangular flange that projects between adjacent studs 40 carried on flange 26. Studs 40 can be fitted with washers 62 and 64 which engage against opposing edge surfaces of lip 60.

It is not necessary that lip 60 be tightly engaged between adjacent studs 40 without any play or limited freedom of rotational movement. It is, however, preferred that there be no play in the rotational interlock between flange 26 and lock means 30 to avoid any chance that noise or clatter may be generated during engine operation. To provide a secure interlock with the varied dimensions experienced with a plurality of engine models and types, lip 60 is sized sufficiently narrow for positioning between the most closely spaced pair of adjacent studs 40 and one or both of washers 62 and 64 bear an eccentric aperture 66 whereby the washer can serve as a locking cam means, permitting its rotation to bind lip 60 in a secure detenting position. In this manner, a plurality of engine models and types having flanges, 26, of varied diameters and varied locations of apertures for receiving studs 40. Washers 62 and 64 can be supplied in a retrofit kit with the lock means 30. The preferred construction is shown with the circular washers 62 positioned at the thrust-bearing edges of lip 60, avoiding any tendency for the interlock to be loosened by the thrust applied to the lock means.

Referring now to FIG. 2, the base 54 of bracket 30 preferably bears means for securing each bracket to spider 16 against rotational movement thereon. Such means is illustrated as a dependent finger 68 that projects past the plane of base 54 and engages against an inner peripheral edge margin of central aperture 44 of spider 26.

Referring now to FIG. 4, the lock means of the invention can assume a variety of shapes and configurations. As shown in FIG. 4, the lock means can comprise resilient means in the form of a tension spring having a base portion, in the form of bracket 72, that is apertured at 74 for its removable attachment to the screw fasteners 40 carried by the flange 26 of the cooling fan assembly. The spring arm 76 projects to the spider 16 of the cooling fan and is secured thereto against rotational movement by a detent in the form of a reverse bend or hook 78 carried at the end of the spring arm 76 which engages over an outer portion of spider 16, as illustrated.

Referring now to FIG. 5, the lock means 30 described in FIG. 1–3 is shown in perspective view. As there illustrated, the lock means 30 comprises a base 54 having a generally slotted aperture 56 extending along a substantial portion of its depth. The base bears an upstanding and dependent arm 58 which, in turn, bears a dependent lip 60. Slot 56 is carried into arm 58 to permit the facile installation of lock means 30 over the ends of studs 50 carried by the cooling fan housing. FIG. 5 also illustrates finger 68 which projects downwardly beneath the plane of base 54 and serves as a rotational detent that bears against an inner peripheral edge of aperture 44 in spider 26. To facilitate manufacture, mechanism 30 can be formed from sheet stock and finger 68 can be formed by angle cut 69 into bend 57 formed between base 54 and arm 58.

Referring now to FIG. 6, there is illustrated an alternative lock means 31 which has a configuration similar to that of FIG. 5, including lip 60 and arm 58. The base 55 of lock means 31 bears a dependent leg portion 80 which projects along the same plane as base 55 and which bears a downwardly dependent lip 82. Lip 82 is configured to engage an outer peripheral edge of spider 16, e.g., edge portion 17, shown in FIG. 1. The remainder of the base 55 is similar in construction to that of 54 previously described, however slot 56 and prong 68 are not necessary and can be omitted, as shown.

Another, alternative lock means 33 is illustrated in FIG. 7. As there illustrated, the lock means has a base 54 and dependent arm 58 which are slotted at 56 in the manner previously described for the lock means 30 of FIG. 5. The lip 61 of this bracket is similar in construction to lip 60 of FIG. 5, however, one or both edges of lip 61 bear a dependent, abutment flange 63 in a generally perpendicular plane to the plane of lip 61. The abutment flange 63 bears a threaded aperture 65 in which is threadedly engaged set screw 67. Set screw 67 can be turned into abuting engagement against an adjacent stud 40, or nut 42 carried thereon, to accommodate for varied spacings of the studs on various engine types and models while yet insuring a secure engagement between flange 26 and spider 16 that will be free of clatter and noise during engine operation.

FIG. 8 illustrates another embodiment of a lock means. This is shown as lock means 35 which is formed with a base 54, slot 56 and dependent arm 58 similar in construction to those elements described with regard to FIG. 5. In this embodiment, however, the lip 69 carried at the upper end of arm 58 bears a slot 71. Slot 71 is dimensioned to permit lip 69 to be slid over a stud 40 or over a shaft extension attached to a stud 40, thereby providing abutment surfaces at opposite sides of the stud 40 and preventing any rotational movement between spider 16 and flange 26. To insure that slot 71 is securely seated against a received stud 40, the slot can bear a resilient spring 73 that projects into engagement against the received end of a stud 40. Slot 71 can also be tapered, as shown to insure a secure fit over a received stud or shaft extension.

FIG. 9 illustrates another embodiment of the invention which, as in FIG. 5, has a base 54 with finger 68, arm 58 and slot 56. In this embodiment, the upper end of arm 58 bears a bracket plate 75 which is offset and bears a slot 77 to receive a stud 40 carried on flange 26 of the cooling fan drive shaft. The offset of plate 75 provides wrench access to a stud 40 received in slot 77 when installing the lock means. If desired, plate 75 could also bear another offset portion at its opposite side, also slotted, to receive an adjacent stud 40. Since this latter modification would be restrained against twisting by engagement with adjacent studs 40, finger 68 could be eliminated.

FIG. 10 illustrates another embodiment of the locking mechanism generally indicated at 37. This locking mechanism has a lip 69 and a slotted aperture 71 generally similar to those elements similarly identified in FIG. 8, and an upright arm 58 generally similar to that element similarly identified in FIG. 5. Slot 71 receives the end of a stud 40. Frequently, the studs 40 will have insufficient length to project into engagement with slot 71. An extension 79 can be secured to the end of stud 40 or to nut 83 to project the necessary distance for being received within slot 71. Alternatively, stud 40 could be replaced with a cap screw having the necessary extension to project to slot 71. If desired, the end of stud 40 or extension 79 that is received within slot 71 can be coated with a rubber layer 81 to insure silent operaton. The base portion of the bracket, however, comprises a plate 57 of transversely elongated dimensions to extend between adjacent studs 50 carried on the cooling fan housing. The opposite ends of plate 57 bear slots 59 to permit plate 57 slipped over these adjacent studs 50. If desired, slots 59 could be placed at an outwardly diverging angular relationship to fit over studs 50 of various engine types and models having varied spacings of studs 50.

The invention has been described with reference to the presently preferred and alternative embodiments. It is not intended that the invention be unduly limited by this illustration of presently preferred embodiments. Instead, it is intended that the invention be defined by the means and their obvious equivalents set forth in the following claims.

What is claimed:

1. In an automotive cooling fan and hub assembly wherein said fan is coupled to its drive shaft by clutch means including a fan drive shaft bearing a flange at one end with cooperative screw fasteners for securing said shaft in driven relationship to an engine; a clutch housing on the opposite end of said shaft and clutch means mounted therein for providing a modulated interconnection between said shaft and said fan; a cooling fan comprising a spider plate having a central aperture receiving said clutch housing and dependent fan plates carried on the clutch housing and secured thereto by screw fasteners; the improvement comprising:

mechanical lock means detachably secured to one member of said shaft flange and spider plate members and bearing slot means for detachable engagement with said screw fasteners carried on said one member;

arms means dependent on said base and extending into engagement with the other member of said shaft flange and spider plate members, and interlock means carried on said arm for securing said arm to said other member.

2. The assembly of claim 1 wherein said base is detachably secured to the cooling fan spider plate member.

3. The assembly of claim 2 including finger means projecting from said base into engagement with an inner peripheral edge of the central aperture of said spider plate.

4. The assembly of claim 3 wherein said base bears slot means to receive said screw fasteners of said cooling fan whereby said base is detachably secured to said spider plate of said cooling fan.

5. The assembly of claim 4 wherein said slot means extend into said arm means to permit facile installation of said base over at least one of said screw fasteners.

6. The assembly of claim 3 wherein said interlock means comprises lip means dependent from said arm means and projecting between adjacent screw fasteners carried on said flange.

7. The assembly of claim 6 wherein at least one of said adjacent screw fasteners carried on said flange bear eccentric washers that can be rotated cam-wise into binding engagement with said lip means.

8. The assembly of claim 6 wherein said lip means bear slot means at its opposite ends for receiving said adjacent screw fasteners.

9. The assembly of claim 8 wherein said slot means are in outwardly divergent angular relationship to accomodate varied spacings between said adjacent screw fasteners.

10. The assembly of claim 3 wherein said lip means bear a central slot to receive a screw fastener carried on said flange.

11. The assembly of claim 3 wherein said lip bears a dependent abutment flange and set screw means threadably carried therein and projecting into engagement with at least one of said screw fasteners carried on said flange.

* * * * *